US009440245B2

(12) United States Patent
Borgström et al.

(10) Patent No.: US 9,440,245 B2
(45) Date of Patent: Sep. 13, 2016

(54) CENTRIFUGAL SEPARATOR WITH INLET ARRANGEMENT IN THE FORM OF A SET OF ANNULAR DISCS OR A HELICALLY SHAPED ELEMENT

(71) Applicants: ALFA LAVAL CORPORATE AB, Lund (SE); SYNCRUDE CANADA LTD., Fort McMurray (CA)

(72) Inventors: Leonard Borgström, Tyresö (SE); Lasse Hurnasti, Huddinge (SE); Daniel John Bulbuc, Sherwood Park (CA); David Harold Childs, Edmonton (CA); Thaddeus Eugene Kizior, Spruce Grove (CA); Kevin Reid, Edmonton (CA)

(73) Assignees: ALFA LAVAL CORPORATE AB, Lund (SE); SYNCRUDE CANADA LTD., Fort McMurray (CA)

( * ) Notice: Subject to any disclaimer, the term of this patent is extended or adjusted under 35 U.S.C. 154(b) by 9 days.

(21) Appl. No.: 14/375,070

(22) PCT Filed: Feb. 15, 2013

(86) PCT No.: PCT/EP2013/053097
§ 371 (c)(1),
(2) Date: Jul. 28, 2014

(87) PCT Pub. No.: WO2013/121009
PCT Pub. Date: Aug. 22, 2013

(65) Prior Publication Data

US 2015/0024921 A1 Jan. 22, 2015

(30) Foreign Application Priority Data

Feb. 15, 2012 (EP) ..... 12155584

(51) Int. Cl.
*B04B 11/06* (2006.01)
*B04B 7/14* (2006.01)
*B04B 1/08* (2006.01)

(52) U.S. Cl.
CPC ..... *B04B 11/06* (2013.01); *B04B 1/08* (2013.01); *B04B 7/14* (2013.01)

(58) Field of Classification Search
CPC ..... B04B 11/06; B04B 1/08; B04B 7/14
USPC ..... 494/64, 67–73, 66
See application file for complete search history.

(56) References Cited

U.S. PATENT DOCUMENTS

RE11,440 E * 9/1894 Malmros ..... 494/66
1,277,676 A * 9/1918 Wright ..... 494/53

(Continued)

FOREIGN PATENT DOCUMENTS

CH 236747 A 3/1945
CN 86107227 A 5/1987

(Continued)

*Primary Examiner* — Charles Cooley
(74) *Attorney, Agent, or Firm* — Birch, Stewart, Kolasch & Birch, LLP

(57) ABSTRACT

The invention relates to a centrifugal separator comprising a rotor arranged to be rotatable around an axis of rotation (x). An inlet chamber is formed in the rotor and an inlet pipe extends into the rotor and has an opening in the inlet chamber for supply of a liquid mixture of components. An inlet arrangement is provided in the inlet chamber, comprising a set of annular discs coaxial with the rotor and forming passages for liquid between the discs, or a helically shaped element coaxial with the rotor and forming passages for liquid between the windings of the helically shaped element. The separator further comprises vanes arranged upstream of the inlet arrangement such as to cause a pre-rotation and pre-acceleration of the liquid mixture. The vanes may be provided on a removable element of the rotor.

21 Claims, 3 Drawing Sheets

(56) References Cited

U.S. PATENT DOCUMENTS

| | | | | | |
|---|---|---|---|---|---|
| 1,760,071 | A | * | 5/1930 | Koepke | 494/67 |
| 2,294,468 | A | | 9/1942 | Lindgren | |
| 2,319,653 | A | | 5/1943 | Zachariassen | |
| 2,668,008 | A | * | 2/1954 | Spross | 494/41 |
| 3,967,777 | A | * | 7/1976 | Canevari | B03B 9/02 494/27 |
| 4,430,071 | A | * | 2/1984 | Willus et al. | 494/38 |
| 4,701,158 | A | * | 10/1987 | Inge et al. | 494/74 |
| 4,721,505 | A | * | 1/1988 | Inge et al. | 494/74 |
| 4,824,430 | A | * | 4/1989 | Kashihara et al. | 494/22 |
| 5,045,049 | A | * | 9/1991 | Lantz | 494/70 |
| 5,052,996 | A | * | 10/1991 | Lantz | 494/68 |
| 5,300,014 | A | * | 4/1994 | Chin | B04B 1/10 494/35 |
| 5,362,292 | A | * | 11/1994 | Borgstrom et al. | 494/74 |
| 5,713,826 | A | * | 2/1998 | West | 494/45 |
| 5,720,705 | A | * | 2/1998 | Inge et al. | 494/37 |
| 6,533,713 | B1 | * | 3/2003 | Borgstrom et al. | 494/66 |
| 7,306,556 | B2 | * | 12/2007 | Pitkamaki et al. | 494/67 |
| 7,775,963 | B2 | * | 8/2010 | Samways et al. | 494/49 |
| 8,308,626 | B2 | * | 11/2012 | Klintenstedt | 494/64 |
| 8,585,566 | B2 | * | 11/2013 | Mackel et al. | 494/70 |
| 9,132,435 | B2 | * | 9/2015 | Mackel | B04B 1/08 |
| 2007/0032363 | A1 | * | 2/2007 | Pitkamaki et al. | 494/67 |
| 2009/0137378 | A1 | * | 5/2009 | Klintenstedt | 494/60 |
| 2012/0108413 | A1 | * | 5/2012 | Mackel | 494/65 |
| 2015/0024921 | A1 | * | 1/2015 | Borgstrom et al. | 494/37 |

FOREIGN PATENT DOCUMENTS

| | | | | |
|---|---|---|---|---|
| CN | 201150880 | Y | | 11/2008 |
| DE | 102006047478 | A1 | * | 4/2007 |
| EP | 0225707 | B1 | | 10/1989 |
| EP | 1105219 | B1 | | 7/2008 |
| SU | 992099 | A1 | | 1/1983 |
| WO | WO 91/12082 | A1 | | 8/1991 |
| WO | WO 00/10714 | A1 | | 3/2000 |
| WO | WO 2011/004014 | A1 | | 1/2011 |

* cited by examiner

CENTRIFUGAL SEPARATOR WITH INLET ARRANGEMENT IN THE FORM OF A SET OF ANNULAR DISCS OR A HELICALLY SHAPED ELEMENT

TECHNICAL FIELD

The invention relates to centrifugal separators for separation of a liquid mixture of components into at least a first component and a second component.

BACKGROUND ART

Some liquid mixtures are sensitive to high shear forces which may cause a disruption of droplets, particles or agglomerates of particles in the liquid mixture. For example shearing of an emulsion of two immiscible liquids such as oil and water reduces drop sizes and makes separation more difficult. It may therefore be an object to provide gentle acceleration of the liquid mixture when entering into the rotor of the separator, rotating at high speed.

An example of a centrifugal separator having an inlet which is gentle to the liquid mixture of components is disclosed in EP 0225707 B1. This document discloses a centrifugal separator provided with an inlet arrangement in the form of a set of annular discs arranged coaxially with the rotor and forming passages for liquid between them.

Another example of a centrifugal separator having an inlet which is gentle to the liquid mixture of components is disclosed in EP 1105219 B1. This document discloses a centrifugal separator provided with an inlet arrangement in the form of a helically shaped element extending along the inlet pipe, forming passages for liquid between adjacent windings of the element.

A further example of a centrifugal accelerator is disclosed in WO 91/12082, in which the inlet comprises a smooth baffle disc and a number of entraining discs for gently entraining a supplied liquid.

However, in some applications, an inlet arrangement as disclosed in prior art may cause an internal overflow within the centrifugal separator, in particular at high inlet flow. Upon such conditions, the unseparated liquid mixture may overflow into the outlet for separated liquid, thereby impairing the separation quality.

SUMMARY

It is an object of the present invention to provide a centrifugal separator with an inlet which is gentle to the liquid mixture which is to be separated while minimising the risk of internal overflow in the separator rotor.

Thus, the present invention relates to a centrifugal separator comprising a rotor arranged to be rotatable around an axis of rotation (x), and an inlet chamber formed in the rotor. The separator is provided with an inlet pipe extending into the rotor having an opening in the inlet chamber for supply of a liquid mixture of components and an inlet arrangement in the inlet chamber. The inlet arrangement comprises a set of annular discs coaxial with the rotor and forming passages for liquid between the discs, or a helically shaped element arranged coaxial with the rotor and forming passages for liquid between the windings of the helically shaped element. The separator further comprises vanes arranged upstream of the inlet arrangement such as to cause a pre-rotation and pre-acceleration of the liquid mixture.

Thus, by causing a pre-rotation and pre-acceleration of the liquid mixture the centrifugal forces acting on the liquid mixture will to a greater extent force the liquid mixture between the passages for liquid between the discs of the inlet arrangement, thereby minimising the risk of internal overflow, short circuiting the inlet with the separator outlet. In other words, the vanes are arranged to cause pre-acceleration of the supplied liquid, in contrast to e.g. a prior art smooth baffle as disclosed in WO 91/12082. A smooth baffle may instead in itself cause retardation of the incoming liquid, i.e. the opposite of acceleration.

An inlet arrangement in the form of a set of annular discs may be an inlet arrangement as further disclosed in EP 0225707 B1 and an inlet arrangement in the form of a helically shaped element may be an inlet arrangement as further disclosed in EP 1105219 B1.

The vanes may be comprised in the rotor. Thus the pressure needed to feed liquid into the rotor may be limited since the motor of the centrifugal separator is used to accelerate the liquid.

The vanes may be arranged on an element forming part of the wall of the inlet chamber facing the opening of the inlet pipe. Thus the liquid mixture meets the vanes and is accelerated upon entry into the inlet chamber.

The element may be a removable element of the rotor. Further, the element may be sleeve-shaped. As an alternative, the removable element may be disc shaped. Thus the form and dimensions of the vanes may be altered to reflect different operating conditions. The element may thus also be replaceable if subjected to wear.

The vanes may extend inwards to a radial position inside the inlet pipe wall at the opening of the inlet pipe and/or extend outwards to a radial position outside the inlet pipe wall at the opening of the inlet pipe. Thus, the inlet flow will pass the vanes upon passing a passage between the inlet pipe and the wall of the inlet chamber facing the opening of the inlet pipe.

Further, the vanes may extend radially outwards to a radial position that leaves a passage for the liquid mixture between the vanes and the wall of the inlet chamber, thereby allowing supplied liquid mixture to pass the passage after passing the vanes, i.e. before passing the inlet arrangement. This may decrease the risk of further mixing the inlet liquid. In other words, the inlet chamber may have a radius of $R_{chamber}$ from rotational axis X at the position of the vanes, and the vanes may extend radially outwards in the inlet chamber to position $R_{out}$ from rotational axis X, wherein $R_{out}<R_{chamber}$. The radial extension may be the extension along the flow of liquid. The position of the vanes may be a position vertically below the opening of the inlet pipe if the inlet pipe extends into the separator from the top. Consequently, $R_{out}$ may be located such that a passage is formed between the vanes and the inlet chamber wall, wherein the passage is large enough to allow passage of the liquid mixture. This is advantageous in that the vanes then both provide acceleration of the inlet mixture and still allow a suitable inlet pressure. As an example, $R_{out}$ may extend to less than 90% of $R_{chamber}$, such as about 30-85% of $R_{chamber}$, such as about 50-75% of $R_{chamber}$. It should be understood that the radial extension of the vanes does not have to "start" from rotational axis X, but the vanes may start from a radial position $R_{start}$ that leaves a passage or distance to rotational axis X. As an example, the central nave nut or a part of the central nave nut of the separator, such as the top of the central nave nut, may extend into the passage between the vanes and rotational axis X. As discussed above, the vanes may extend inwards to a radial position that is inside the inlet pipe wall at the opening of the inlet pipe, i.e. $R_{start}$ may be located radially inside the opening of the inlet pipe. With the terminology used above, the extension of a vane $R_{vane}$ is $R_{out}$-$R_{start}$. As an example, $R_{vane}$ may be about 5-80% of $R_{chamber}$, such as about 10-70% of $R_{chamber}$, such as about 20-50% of $R_{chamber}$, such as about 25-35% of $R_{chamber}$.

The removable element may be fastened to the rotor at a central nave portion of the rotor. The centrifugal separator may further comprise a spindle, wherein the rotor is attached to the spindle at the central nave portion by means of a nave nut and wherein the removable element is fastened to the rotor by means of the nave nut. Thus the removable element may be replaceable in a simple manner.

The inlet arrangement may comprise a plurality of walls connecting adjacent annular discs or windings. The walls may extend in a radial direction, extend in a direction having an angle with the radial direction, or be curved. The plurality of walls may be arranged such that a plurality of channels is formed between each annular disc or along each winding revolution. Thus the acceleration of the liquid mixture is improved when entering the passages between the discs or windings of the inlet arrangement.

The vanes may be comprised in the rotor and may, in a plane perpendicular to the axis of rotation (x), be arranged in a radial direction, arranged in a direction having an angle to the radial direction or be curved.

As an alternative, the vanes may be formed in the inlet pipe and arranged in such a manner as to cause the pre-rotation and pre-acceleration of the liquid mixture. Thus the liquid mixture may be provided with a pre-rotation and pre-acceleration caused before entering the rotor. Such vanes may be curved or arranged at an angle to the flow of liquid mixture.

Each vane may have an extension along the flow of liquid mixture during operation of the separator, and each vane may have a substantially rectangular or wing profiled cross-section along this extension. Such a wing profile cross-section may comprise a rounded leading edge meeting the flow of liquid, and a sharp trailing edge. Thus, the hydrodynamic properties of the vanes may be optimised.

Further, the centrifugal separator may comprise at least three vanes, such as at least five vanes, such as at least eight vanes, such as at least ten vanes, such as at least twelve vanes, such as at least fifteen vanes. The vanes may be of the same radial length.

Furthermore, the centrifugal separator may be adapted for an inlet flow of liquid mixture that is at least 80 $m^3$/hour, such as at least 100 $m^3$/hour, such as about 150 $m^3$/hour.

As a further aspect of the invention, there is provided a method for separating components in a liquid mixture comprising the steps of a) providing a centrifugal separator according the present disclosure and a liquid mixture to be separated; and
b) separating at least one component from the liquid mixture using the separator.

Step b) may comprise supplying the separator with the liquid mixture at an inlet flow of at least 80 $m^3$/hour, such as at least 100 $m^3$/hour, such as about 150 $m^3$/hour.

The liquid mixture may comprise solids. As an example, the liquid mixture may comprise water, naphtha and bitumen. For example, the water content of the liquid mixture may be about 25-30% (w/w). The naphtha may be full range naphtha and may comprise a fraction of hydrocarbons in petroleum that boils between 30° C. and 200° C. Further, the naphtha may comprise light naphtha, which may be the fraction of hydrocarbons boiling between 30° C. and 90° C. The light naphtha may comprise molecules with 5-6 carbon atoms. Further, the naphtha may comprise heavy naphtha, which may be the fraction of hydrocarbons boiling between 90° C. and 200° C. The heavy naphtha may comprise molecules with 6-12 carbons.

Bitumen, sometimes referred to as asphalt, refers to a highly viscous liquid, semi-solid or solid form of petroleum. Bitumen may be sticky and black. Consequently, solids of the liquid mixture may comprise bitumen. The bitumen may originate from oil sands, tar sands and/or bituminous sands. Bitumen may be petroleum that exists in the semi-solid or solid phase in natural deposits. Bitumen may thus be a thick, sticky form of hydrocarbon, and may have a density and/or viscosity high enough such that it does not flow unless heated or diluted with lighter hydrocarbons. Bitumen may be oil having a viscosity greater than 10,000 centipoises under reservoir conditions and an API gravity of less than 10° API.

The separator of the present disclosure may be efficient for separating components of a liquid mixture comprising solids, such as a liquid mixture comprising water, naphta and bitumen. Thus, the separator of the present disclosure may be used in the extraction of oil from oil sands, tar sands and/or bituminous sands.

Still other objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1:
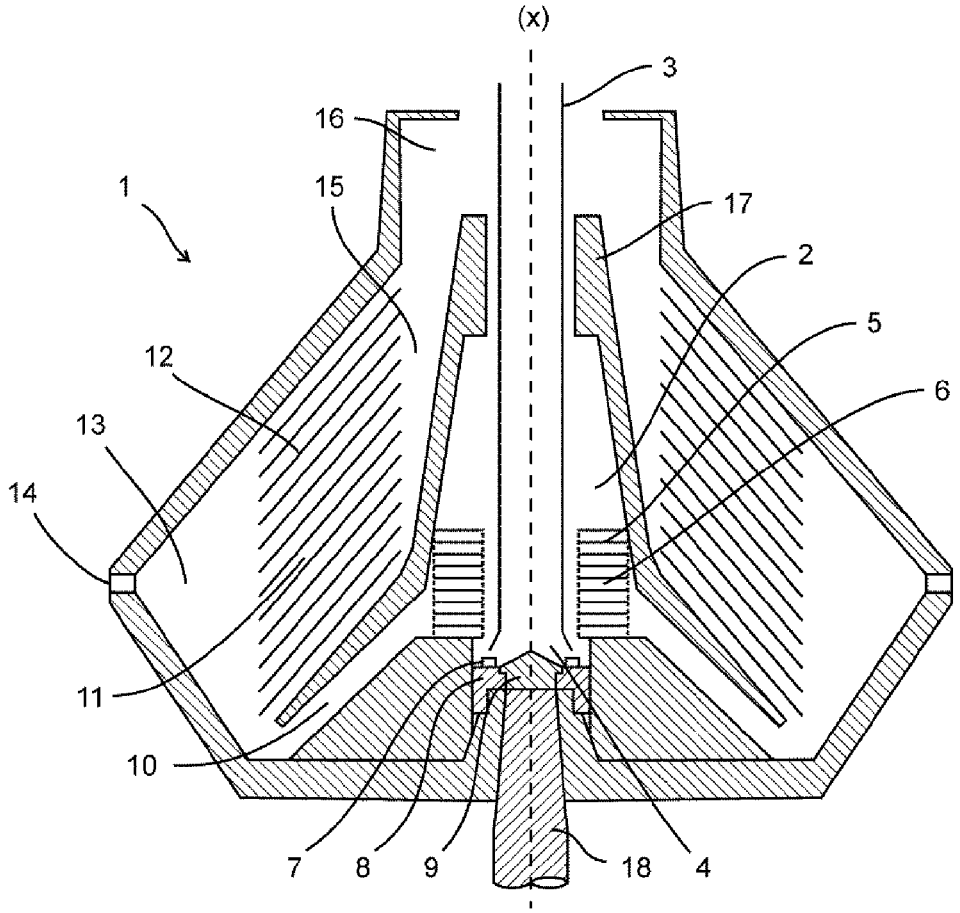
FIG. 1 shows a portion of a centrifugal separator in cross-section.

With reference to FIG. 1 a portion of a centrifugal separator is shown comprising a rotor 1 supported by a spindle 18 (partly shown) which is rotatably arranged in a frame around an axis of rotation (x). The rotor comprises an inlet chamber 2 formed within a distributor 17 into which a stationary inlet pipe 3 extends for supply of a liquid mixture of components to be separated. The rotor further comprises a separation space 11, in communication with the inlet chamber via passages 10 in the rotor.

Figure 2:
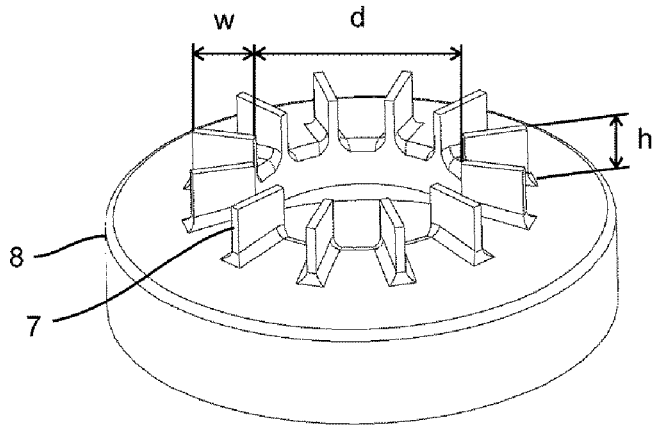
FIG. 2 shows a removable element in the form of a nave sleeve comprising vanes.

The inlet pipe has an opening 4 for supply of a liquid mixture of components into the inlet chamber. The opening is directed towards a part of the wall of the inlet chamber comprising a nave nut 9 and a removable element in the form of a nave sleeve 8. The nave nut is arranged to fasten the rotor to the spindle, and to fasten the nave sleeve to the rotor. The nave sleeve is provided with vanes 7 protruding from the sleeve element and directed towards the inlet pipe. With reference to FIG. 2, further details of the removable element in the form of a nave sleeve are shown. In the example shown here the nave sleeve is provided with twelve vanes protruding from the upper surface of the element and extending in a radial direction. If the radial extension of the vanes is large, the inlet pressure may increase, and it may therefore be beneficial to limit the extension of the vanes. The radial span w of each vane is 11-22 mm and the inner diameter d is 67 mm. A radial span of 11 mm was advantageous in view of the limited effect on the inlet pressure. The height h of the vanes is 18 mm.

The rotor shown in FIG. 1 further comprises an inlet arrangement having a stack of acceleration discs 5 forming passages 6 for liquid, and provided in communication with the inlet chamber and the passages 10. The passages are delimited by walls extending in a radial direction, in parallel with the rotational axis (x). These walls connect adjacent discs, thus forming channels between the discs extending in a radial direction. Referring to FIG. 1, the vanes 7 have an upstream end and a downstream end and the stack of acceleration discs 5 is located downstream of the downstream ends of the vanes 7. The stack of acceleration discs could also be a helically shaped element. As can also be understood from FIG. 1, the vanes 7 are located below the set of annular discs 7 or the helically shaped element In the separation space 11, a stack of frusto-conical separation discs 12 is arranged, along and coaxial with the rotational axis (x). The outer portion of the separation space, radially outside the separation discs, forms a sludge space 13 for a first separated component of the liquid mixture having a higher density (a heavy phase). Outlets 14 in the form of nozzles extend from the sludge space for discharge of separated components collected therein. The inner portion 15 of the separation space, radially inside the separation discs, constitutes a space for a second separated component of the liquid mixture having a lower density (a light phase). The inner portion 15 of the separation space communicates with an outlet for light phase 16.

During operation of the centrifugal separator according to FIG. 1, provided with a nave sleeve according to FIG. 2, the rotor 1 rotates at an operational speed. A liquid mixture of components to be separated is introduced into the inlet chamber 2 from the stationary inlet pipe 3 and via the opening 4. The liquid mixture meets the rotating wall portion of the inlet chamber facing the opening of the inlet pipe and is forced radially outwards. When passing the vanes 7 in the passage between the wall portion and the brim of the opening of the inlet, the liquid mixture is accelerated into rotation. Thus, the liquid mixture is provided with a pre-rotation and pre-acceleration when entering into the portion of the inlet chamber comprising the inlet arrangement 5, 6 (downstream of the vanes). Due to the pre-rotation, the liquid mixture is subjected to a centrifugal force facilitating the passage of the liquid mixture into the passages 6 between the discs 5 of the inlet arrangement. In these passages the liquid mixture is further accelerated such as to rotate with the rotor. The liquid mixture is then led into the separation space 11 via the passages 10 in the rotor. In the separation space, subjected to centrifugal forces and facilitated by the separation discs 12, the liquid mixture is separated into at least a first separated component of the liquid mixture having a higher density (heavy phase) and a second separated component of the liquid mixture having a lower density, (light phase). The heavy phase is collected in the sludge space 13 and discharged via the outlets 14. The light phase is collected at the inner portion 15 of the separation space from which it is discharged via the light phase outlet 16.

If the liquid mixture of components is not subjected to the described pre-rotation, there is a risk that it overflows the radially inner edge of the distributor 17 (between the distributor 17 and the inlet pipe 3), in particular at high flow of liquid mixture. Upon such conditions, unseparated liquid mixture may overflow from the inlet chamber 2 into the outlet chamber 16 for light phase, thereby impairing the separation quality.

Figure 3:
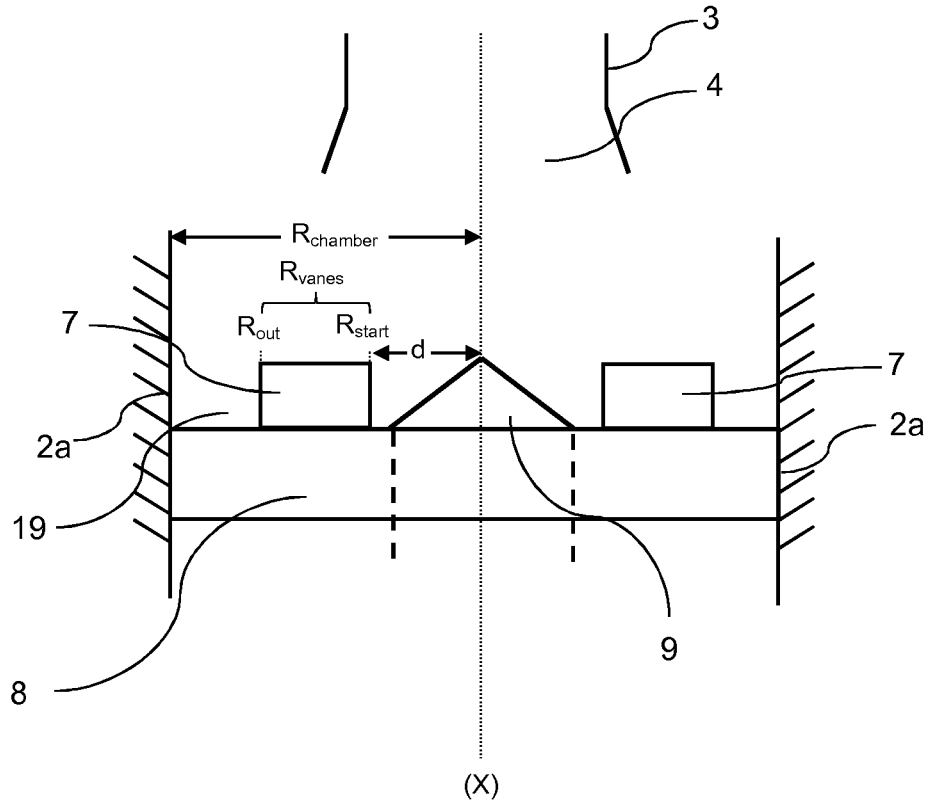
FIG. 3 shows a cross-section and illustrates schematically an embodiment of the extension of the vanes in relation to the inlet chamber when a removable element comprising vanes is arranged in a centrifugal separator.
Figure 4A:
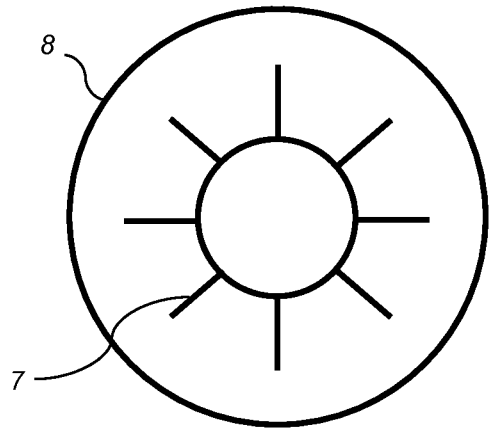
FIG. 4A is a schematic view illustrating straight vanes.
Figure 4B:
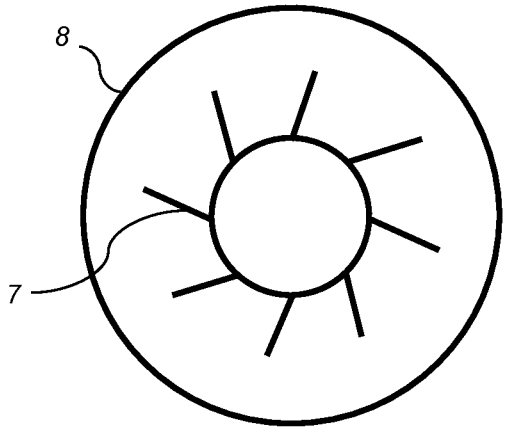
FIG. 4B is a schematic view illustrating vanes at an angle to the radial direction.
Figure 4C:
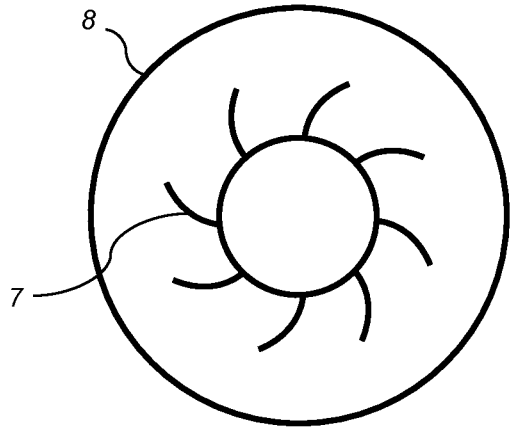
FIG. 4C is a schematic view illustrating curved vanes.

FIG. 3 further illustrates an embodiment of a removable element 8 when arranged in a centrifugal separator. The element 8 comprises vanes 7 and is arranged vertically below the opening 4 of the inlet pipe 3 between the walls 2*a* of the inlet chamber. The element 8 is arranged on a nave nut 9 as discussed in relation to FIG. 1 above. The element 8 is centered around rotational axis X and the inlet chamber has a radius of $R_{chamber}$ from rotational axis X at the position of the vanes 7. The vanes 7 extend from position $R_{start}$ and extend radially outwards to position $R_{out}$. $R_{out}$ is positioned at a position from X that is less than $R_{chamber}$, thereby leaving a passage 19 for liquid mixture that has passed the vanes 7. The passage 19, located between the vanes 7 and the inlet chamber wall 2*a*, is thus positioned downstream of the vanes 7 when liquid is supplied from liquid pipe 3. Further, $R_{start}$ is located with a distance d from rotational axis X but is still positioned radially inside the inlet pipe wall at the opening 4 of the inlet pipe 3. The vanes 7 may abut the portion of the nave nut 9 that protrudes through the element 8 or the vanes may be arranged on element 8 with a short distance to the portion of the nave nut 9 that protrudes through the element 8. The radial extension, or length, of a vane is $R_{vane}$ and is hence $R_{out}$-$R_{start}$. In this example, $R_{vane}$ is about 25-35% of $R_{chamber}$. The distance d may for example be about 5-80% of $R_{chamber}$, such as about 10-70% of $R_{chamber}$, such as about 20-50% of $R_{chamber}$, such as about 25-35% of $R_{chamber}$. In this example, d is about 25-35% of $R_{chamber}$. Consequently, distance d may have a length that is about equal to the extension of a vane, i.e. d may be about equal to $R_{vane}$ in radial length.

The invention claimed is:

1. A centrifugal separator comprising:

a rotor arranged to be rotatable around a vertical axis of rotation; an inlet chamber formed in the rotor;

an inlet pipe extending into the rotor, said inlet pipe having an opening in the inlet chamber for supply of a liquid mixture of components;

an inlet arrangement in the inlet chamber, comprising:

a set of annular discs coaxial with the rotor and forming passages for liquid between the discs; or a helically shaped element coaxial with the rotor and forming passages for liquid between windings of the helically shaped element; and vanes arranged upstream of the inlet arrangement such as to cause a pre-rotation and pre-acceleration of the liquid mixture, wherein the vanes have an upstream end and a downstream end and the set of annular discs or the helically shaped element is located downstream of the downstream ends of the vanes, and wherein the vanes are located vertically below the set of annular discs or the helically shaped element.

2. The centrifugal separator according to claim 1, wherein the vanes are located in the rotor.

3. The centrifugal separator according to claim 2, wherein the vanes are arranged on an element forming part of a wall of the inlet chamber facing the opening of the inlet pipe.

4. The centrifugal separator according to claim 3, wherein the element is a removable element of the rotor.

5. The centrifugal separator according to claim 4, wherein the removable element is fastened to the rotor at a central nave portion of the rotor.

6. The centrifugal separator according to claim 5, further comprising a spindle, wherein the rotor is attached to the spindle at the central nave portion by means of a nave nut and wherein the removable element is a separate element from the nave nut and is fastened to the rotor by means of the nave nut.

7. The centrifugal separator according to claim 4, wherein the removable element is sleeve-shaped.

8. The centrifugal separator according to claim 2, wherein the vanes extend inwards to a radial position inside a wall of the inlet pipe at the opening of the inlet pipe.

9. The centrifugal separator according to claim 2, wherein the vanes extend outwards to a radial position outside a wall of the inlet pipe at the opening of the inlet pipe.

10. The centrifugal separator according to claim 2, wherein said vanes extend radially outwards to a radial position that leaves a passage for the liquid mixture between the vanes and a wall of the inlet chamber, thereby allowing supplied liquid mixture to pass said passage after passing the vanes.

11. The centrifugal separator according to claim 1, wherein the inlet arrangement comprises a plurality of walls connecting adjacent annular discs or windings.

12. The centrifugal separator according to claim 11, wherein the plurality of walls are arranged such that a plurality of channels is formed between each annular disc or along each winding revolution.

13. The centrifugal separator according to claim 1, wherein the vanes, in a plane perpendicular to the axis of rotation, are arranged in a radial direction, arranged in a direction having an angle to the radial direction or curved.

14. The centrifugal separator according to claim 1, wherein the vanes are curved or arranged at an angle to the flow of liquid mixture in the inlet pipe.

15. The centrifugal separator according to claim 1, wherein each vane has an extension along the flow of liquid mixture during operation of the separator, and wherein each vane has a substantially rectangular or wing profiled cross-section along said extension.

16. The centrifugal separator according to claim 1, wherein the vanes are arranged facing the opening of the inlet pipe and extending radially, the vanes being radially spaced a first distance from the axis of rotation and a second distance from an inner circumferential wall of a distributor forming the inlet chamber.

17. The centrifugal separator according to claim 16, wherein the vanes have a radial extent that begins from a position outside a wall of the inlet pipe and ends inside a wall of the inlet pipe.

18. A method for separating components in a liquid mixture comprising the steps of:

providing a centrifugal separator and a liquid mixture to be separated; and separating at least one component from the liquid mixture using the separator, wherein the centrifugal separator comprises: a rotor arranged to be rotatable around a vertical axis of rotation; an inlet chamber formed in the rotor;

an inlet pipe extending into the rotor, said inlet pipe having an opening in the inlet chamber for supply of a liquid mixture of components;

an inlet arrangement in the inlet chamber, comprising:

a set of annular discs coaxial with the rotor and forming passages for liquid between the discs; or a helically shaped element coaxial with the rotor and forming passages for liquid between windings of the helically shaped element; and vanes arranged upstream of the inlet arrangement such as to cause a pre-rotation and pre-acceleration of the liquid mixture, wherein the vanes have an upstream end and a downstream end and the set of annular discs or the helically shaped element is located downstream of the downstream ends of the vanes, and wherein the vanes are located vertically below the set of annular discs or the helically shaped element.

19. The method according to claim 18, wherein said step of separating further comprises the step of supplying the separator with the liquid mixture at an inlet flow of at least 80 $m^3$/hour.

20. The method according to claim 18, wherein the liquid mixture comprises water, naphtha and bitumen.

21. The method according to claim 18, wherein said step of separating further comprises the step of supplying the separator with the liquid mixture at an inlet flow of at least 150 $m^3$/hour.

* * * * *